US010700455B1

(12) United States Patent
Shen

(10) Patent No.: US 10,700,455 B1
(45) Date of Patent: Jun. 30, 2020

(54) ELECTRICAL CONNECTOR WITH IMPROVED TERMINAL STRUCTURE

(71) Applicant: SURE-FIRE ELECTRICAL CORPORATION, New Taipei (TW)

(72) Inventor: Chun-Lai Shen, New Taipei (TW)

(73) Assignee: SURE-FIRE ELECTRICAL CORPORATION, New Taipei (TW)

( * ) Notice: Subject to any disclaimer, the term of this patent is extended or adjusted under 35 U.S.C. 154(b) by 0 days.

(21) Appl. No.: 16/418,045

(22) Filed: May 21, 2019

(51) Int. Cl.

| | |
|---|---|
| ***H01R 12/55*** | (2011.01) |
| ***H01R 13/6585*** | (2011.01) |
| ***H01R 13/40*** | (2006.01) |
| ***H01R 12/51*** | (2011.01) |
| ***H01R 13/502*** | (2006.01) |
| ***H01R 13/6461*** | (2011.01) |

(52) U.S. Cl.
CPC ..... *H01R 12/55* (2013.01); *H01R 12/515* (2013.01); *H01R 13/40* (2013.01); *H01R 13/502* (2013.01); *H01R 13/6461* (2013.01); *H01R 13/6585* (2013.01)

(58) Field of Classification Search
CPC ..... H01R 12/55; H01R 12/515; H01R 13/40; H01R 13/512; H01R 13/6461; H01R 13/6585
USPC ..... 439/660, 850–855, 78, 676
See application file for complete search history.

(56) References Cited

U.S. PATENT DOCUMENTS

| | | | | |
|---|---|---|---|---|
| 5,211,589 | A * | 5/1993 | McCardell | H01R 13/4364 439/176 |
| 6,454,605 | B1 * | 9/2002 | Bassler | H01R 9/034 439/607.23 |
| 6,942,529 | B2 * | 9/2005 | Fujimoto | H01R 4/185 439/886 |
| 7,252,548 | B2 * | 8/2007 | Huang | H01R 24/60 439/607.01 |
| 7,651,379 | B1 * | 1/2010 | Wu | H01R 12/62 439/108 |
| 8,052,477 | B1 * | 11/2011 | Ko | H01R 13/6582 439/660 |
| 9,627,815 | B2 * | 4/2017 | Wu | H01R 13/6581 |
| 10,396,499 | B1 * | 8/2019 | Shen | H01R 13/11 |
| 10,476,208 | B1 * | 11/2019 | Shen | H01R 24/62 |

(Continued)

*Primary Examiner* — Harshad C Patel
(74) *Attorney, Agent, or Firm* — Rosenberg, Klein & Lee

(57) ABSTRACT

An electrical connector with improved terminal structure includes an insulative housing, a terminal set including a terminal block mounted in insulative housing and conductive terminals mounted in terminal block with respective front contact endpieces and rear connection endpieces respectively extended out of the opposite front and rear sides of terminal block, and electrical wires respectively electrically connected to rear connection endpieces of conductive terminal. Front contact endpiece has a curved front contact point and a width gradually reduced from terminal block toward the front contact point so that attenuation of transmission noise is more obvious, improved and stable. Because the width of front contact endpiece is reduced, the spacing between front contact endpieces of each two adjacent conductive terminals is increased so that each two adjacent conductive terminals will not interfere with each other, avoiding noise and crosstalk during signal transmission and ensuring high-frequency signal transmission stability and reliability.

11 Claims, 6 Drawing Sheets

(56) References Cited

U.S. PATENT DOCUMENTS

| | | | | |
|---|---|---|---|---|
| 2003/0017730 | A1* | 1/2003 | Bassler | H01R 9/034 439/108 |
| 2010/0184338 | A1* | 7/2010 | Hou | H01R 13/506 439/660 |
| 2012/0064769 | A1* | 3/2012 | Su | H01R 13/502 439/607.55 |
| 2013/0164990 | A1* | 6/2013 | Tsai | H01R 13/516 439/660 |
| 2016/0013566 | A1* | 1/2016 | Wu | H01R 4/023 439/676 |
| 2016/0172804 | A1* | 6/2016 | Wu | H01R 24/60 439/676 |

* cited by examiner

ELECTRICAL CONNECTOR WITH IMPROVED TERMINAL STRUCTURE

BACKGROUND OF THE INVENTION

1. Field of the Invention

The present invention relates to composite cable technology and more particularly, to an electrical connector with improved terminal structure, in which the width of the front contact endpiece of each conductive terminal is reduced so that the spacing between the front contact endpieces of each two adjacent conductive terminals is increased, and thus each two adjacent conductive terminals will not interfere with each other, avoiding noise and crosstalk during signal transmission.

2. Description of the Related Art

With the rapid development of electronic technology, the resolution of display devices (such as monitors or TVs) is increasing, so that the demand for high transmission bandwidth of audio and video signals has turned the traditional video VGA interfaces into the video interfaces of DVI and Display Port. In order to get clearer images and higher transmission bandwidths, some related interface standards are developed and updated. Thus, high-resolution multimedia interface (HDMI) is developed for transmitting uncompressed audio and video signals. High-resolution multimedia interface (HDMI) is commonly used in consumer electronics, including TVs, computers, players, game consoles, integrated amplifiers, and digital audio devices to ensure that video and audio will not be attenuated during transmission.

Furthermore, as high-definition images gradually become mainstream video standards, and FHD (1920×1080) progresses to the resolution of UHD (3840×2160), displays that support 4K display technology have become more and more popular. Therefore, the conventional data transmission bandwidth can no longer meet the functional requirements of the future video transmission interface. Thus, new HDMI2.1 specification has been developed. The transmission bandwidth of HDMI2.1 has been increased from 18 Gbps of HDMI2.0 to 48 Gbps that supports a variety of higher dynamic image pixels and update rates (such as 4K/120 Hz or 8K/60 Hz) and can support up to 10K/120 Hz using compression technology. In addition to a significant increase in transmission bandwidth, the functional part also incorporates dynamic HDR and low-latency transmission technology, which is compatible with previous HDMI2.0 specification, and up to 10K pixels are also supported for commercial, industrial and other professional applications.

In addition, the transmission lines currently used in consumer electronic products usually use a plug connector to be mated with the socket connector, and various signals and power sources are transmitted to the control circuit through the circuit board to perform corresponding operation functions. The general HDMI connector design adopts the type in which an upper row of terminals and a lower row of terminals are arranged. In installation of the cable, the multiple cores of the cable are soldered to the upper row of terminals and the lower row of terminals. However, as new HDMI connectors are made relatively smaller and the transmission bandwidth is greatly increased, the signal interference caused by the high frequency signal transmission will be more serious, which will affect high-frequency signal transmission quality.

Therefore, how to solve the above-mentioned problems and inconvenience is the direction that the relevant industry is eager to study and improve.

SUMMARY OF THE INVENTION

The present invention has been accomplished under the circumstances in view. It is therefore the main object of the present invention to provide an electrical connector with improved terminal structure, which comprises an insulative housing, a terminal set mounted in the insulative housing, a plurality of electrical wires connected to the terminal set and a shielding housing surrounding the insulative housing. The insulative housing comprises a docking space with an opening in each of opposed front and rear sides thereof. The terminal set comprises a terminal block mounted in the insulative housing, and a plurality of conductive terminals mounted in the terminal block. Each conductive terminal comprises a front contact endpiece extended out of a front side of the terminal block and inserted into the docking space, and a rear connection endpiece extended out of an opposite rear side of the terminal block. The front contact endpiece comprises a curved front contact point. The front contact endpiece has a width gradually reduced from the terminal block toward the front contact point. The electrical wires each comprise a conducting core electrically disposed in contact with the rear connection endpiece of one respective conductive terminal, and an insulative sheath wrapped about the conducting core. The shielding housing defines therein a positioning space that accommodates the insulative housing. Because the width of the front contact endpiece of each conductive terminal reduces gradually from the terminal block toward the front contact point, the attenuation of the transmission noise is more obvious, improved and stable. Because the width of the front contact endpiece is reduced, the spacing between the front contact endpieces of each two adjacent conductive terminals is increased so that each two adjacent conductive terminals will not interfere with each other, avoiding noise and crosstalk during signal transmission and ensuring high-frequency signal transmission stability and reliability.

According to another aspect of the present invention, the rear connection endpieces of the conductive terminals are respectively and firmly secured to the conducting cores and insulative sheaths of the electrical wires by the respective conducting core riveting parts and insulative sheath riveting parts. Because the insulating sheaths of the electrical wires have better elastic deformation characteristics, when the insulating sheath riveting parts are riveted to the respective insulating sheaths, the joint tightness can be improved, thereby ensuring stable electrical connection between the conductive terminals and the electrical wires. Moreover, when the electrical wires are shaken, the electrical wires can be easily prevented from being easily separated from the conductive terminals, thereby achieving the effect of improving the service life.

According to still another aspect of the present invention, the conductive terminals are arranged into an upper row and a lower row. The terminal block comprises an upper block body holding the upper row of conductive terminals, a lower block body holding the lower row of conductive terminals, and a separator set between the upper block body and the lower block body. The separator has separation slots provided for the placement of the rear connection endpieces of the conductive terminals. The conducting cores of the electrical wires are electrically connected with the rear connection endpieces within the respective separation slots. Thus, the multiple separation slots can be used to separate the rear connection endpieces of the conductive terminals, achieving the effect of masking signals and avoiding signal interference between the rear connection endpieces of each two adjacent conductive terminals.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
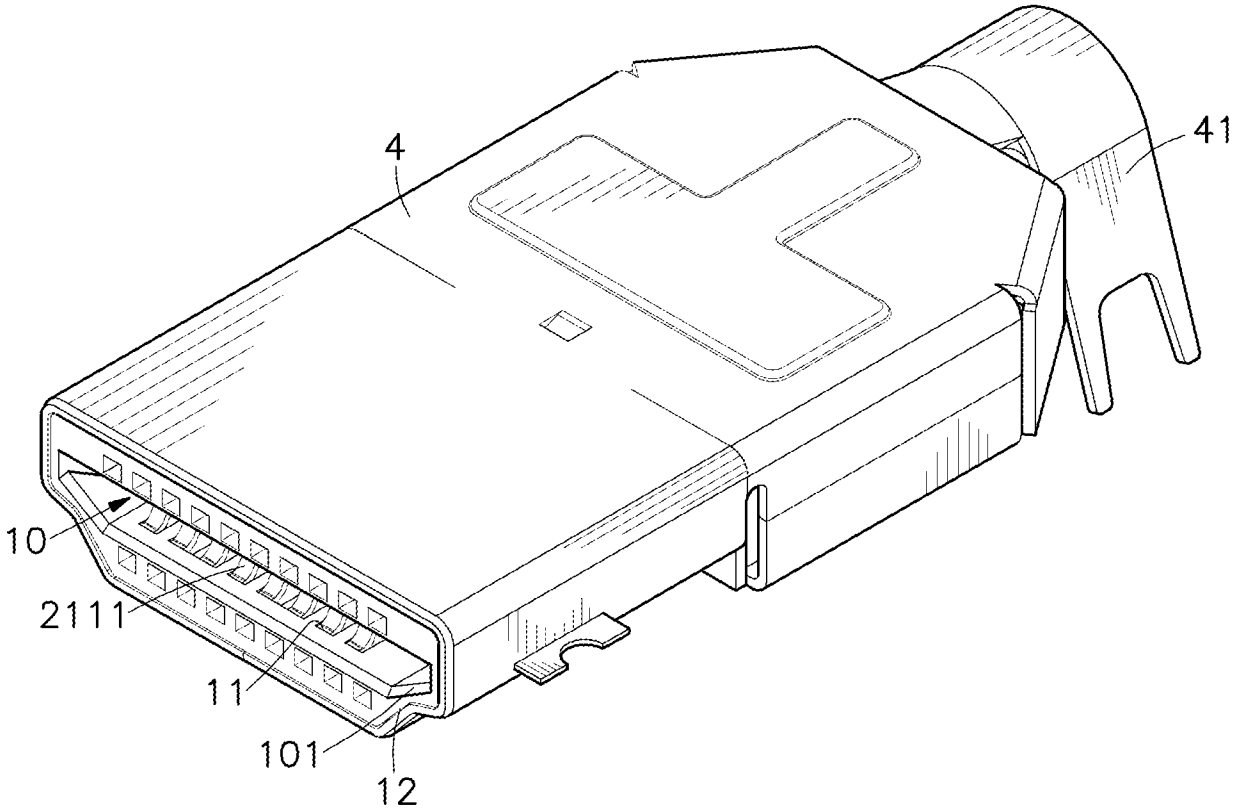
FIG. 1 is an oblique top elevational view of an electrical connector with improved terminal structure in accordance with the present invention.
Figure 2:
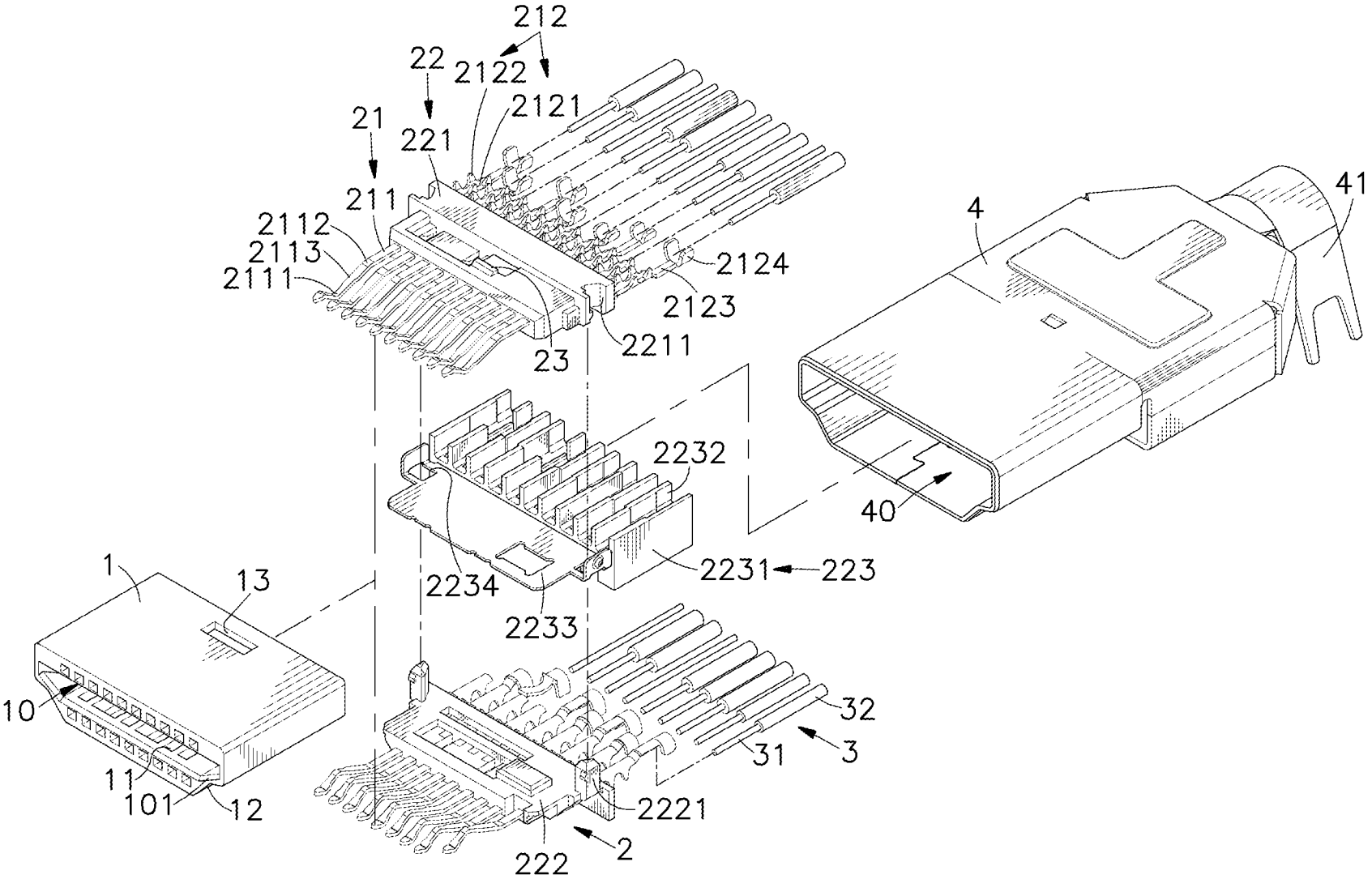
FIG. 2 is an exploded view of the electrical connector with improved terminal structure in accordance with the present invention.
Figure 3:
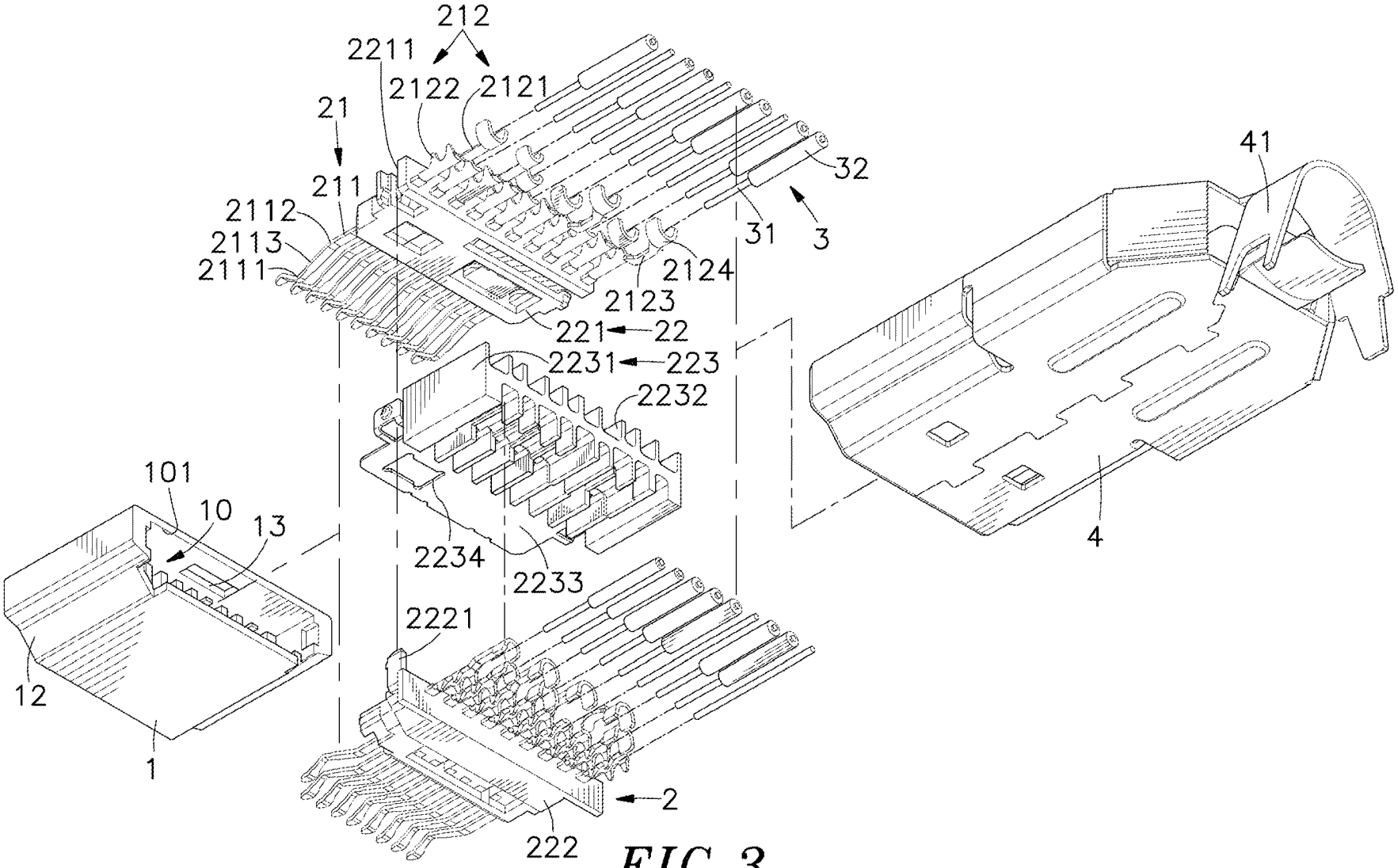
FIG. 3 corresponds to FIG. 2 when viewed from another angle.
Figure 4:
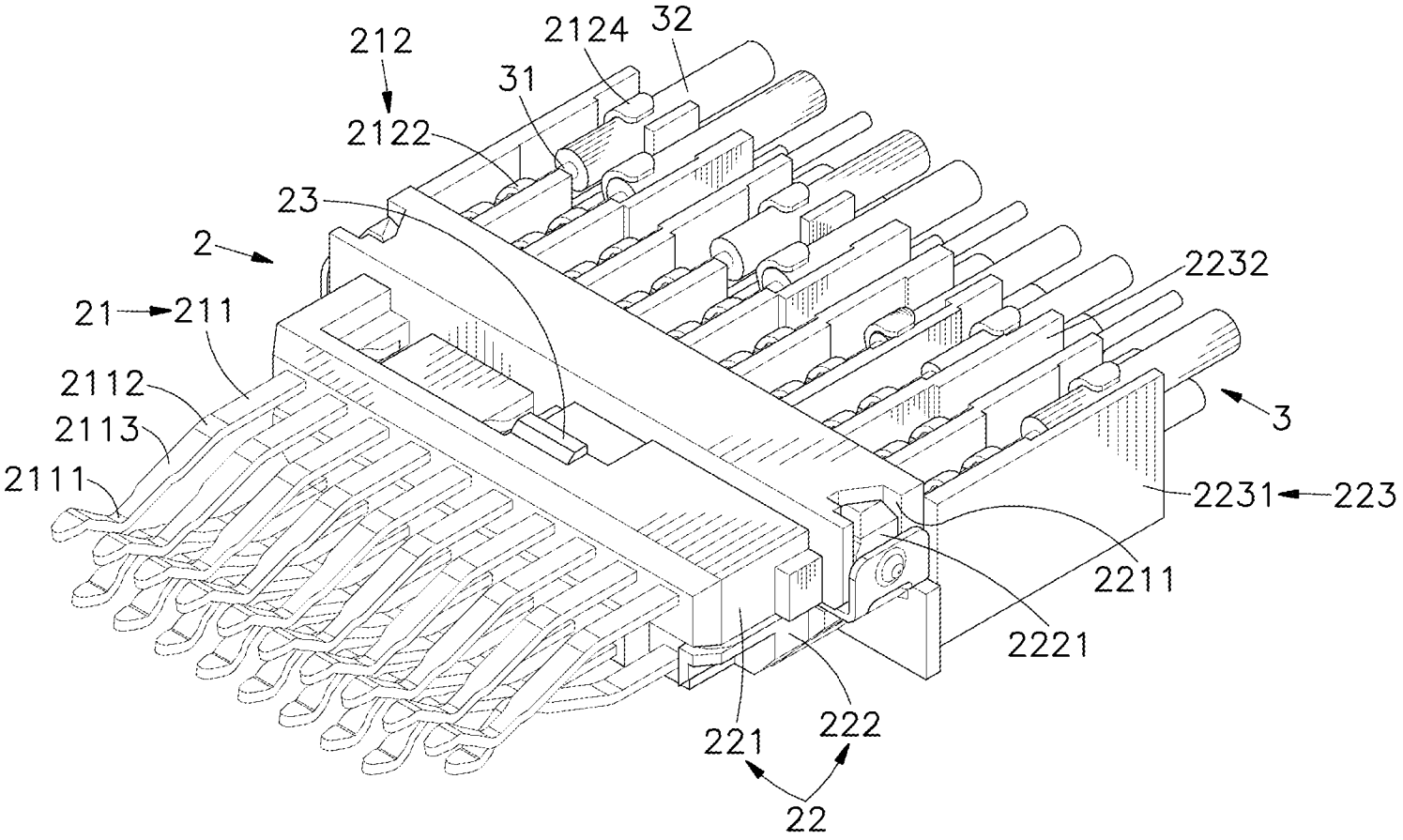
FIG. 4 is an oblique top elevational view of the terminal set.
Figure 5:
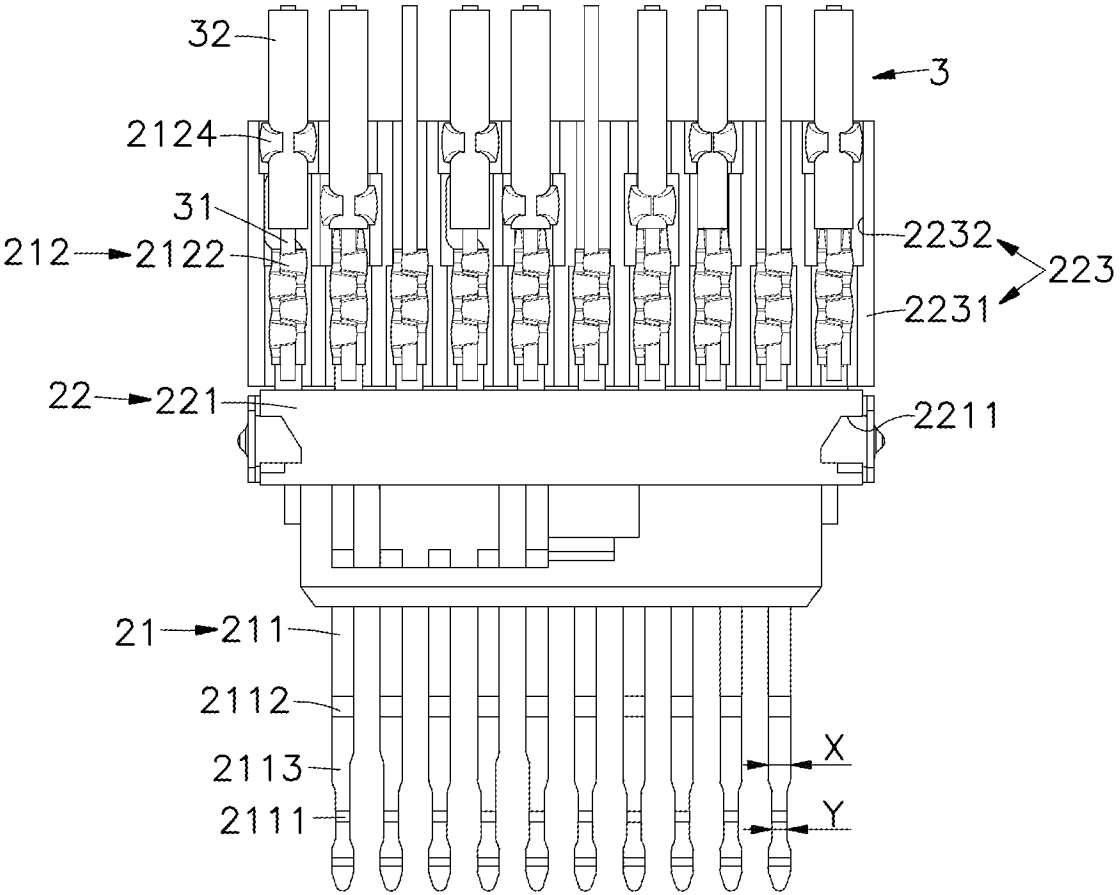
FIG. 5 is a top view of the present invention, illustrating the arrangement of the upper row of conductive terminals of the terminal set, the terminal block and the electrical wires.
Figure 6:
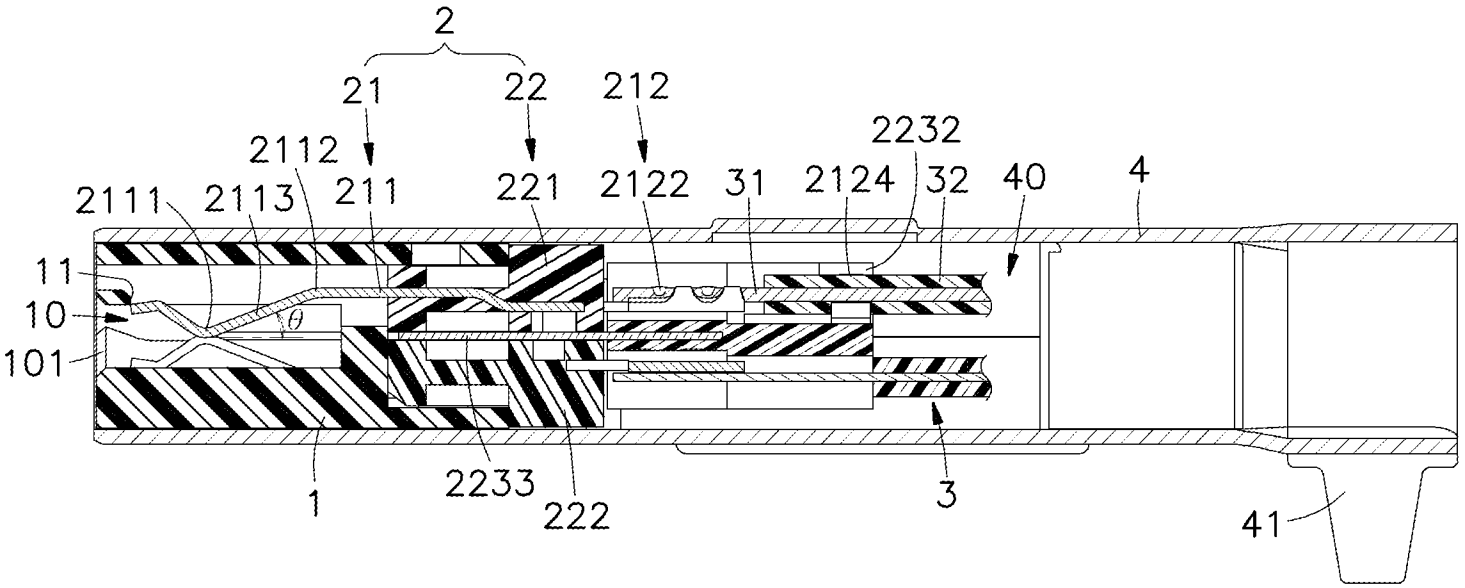
FIG. 6 is a sectional side view of the present invention.

Referring to FIGS. 1-6, an electrical connector with improved terminal structure in accordance with the present invention is shown. The electrical connector with improved terminal structure comprises an insulative housing 1, a terminal set 2, a plurality of electrical wires 3 and a shielding housing 4.

The insulative housing 1 is shaped like a trapezoid, comprising a docking space 10 with an opening 101 in each of opposed front and rear sides thereof, a plurality of terminal grooves 11 disposed in the docking space 10 at opposed top and bottom sides, two contracted surfaces 12 respectively extended from two opposite side walls toward a bottom wall thereof, and a hook hole 13 cut through a top wall thereof near a rear side.

The terminal set 2 comprises upper and lower rows of conductive terminals 21, and a terminal block 22 holding the conductive terminals 21. The conductive terminals 21 are mounted in the terminal block 22, each comprising a front contact endpiece 211 forwardly extended out of a front side of the terminal block 22 and an opposed rear connection endpiece 212 backwardly extended out of an opposed rear side of the terminal block 22. The front contact endpiece 211 comprises a curved-shape front contact point 2111, a bent 2112 disposed between the terminal block 22 and the front contact point 2111, and a contracting portion 2113 connected between the bent 2112 and the front contact point 2111 and gradually reduced in width. The front contact endpiece 211 has a width gradually reduced in direction from the terminal block 22 toward the front contact point 2111. The rear connection endpiece 212 comprises a conducting core riveting part 2121 backwardly suspending outside the rear side of the terminal block 22, a plurality of riveting strips 2122 vertically upwardly extended from the conducting core riveting part 2121 at opposite sides, an insulative sheath riveting part 2123 backwardly extended from the conducting core riveting part 2121, and two fastening strips 2124 vertically upwardly extended from two opposite lateral sides of a rear end of the insulative sheath riveting part 2123.

The terminal block 22 comprises an upper block body 221 for holding the upper row of conductive terminals 21, a lower block body 222 for holding the lower row of conductive terminals 21, and a separator 223 disposed between the upper block body 221 and the lower block body 222. The upper block body 221 has two mounting grooves 2211 respectively located on two opposite sidewalls thereof. The lower block body 222 has two mounting rods 2221 respectively upwardly extended from two opposite sidewalls thereof for engaging into the respective mounting grooves 2211 The separator 223 comprises a base block 2231 disposed at a rear side relative to the upper block body 221 and the lower block body 222, a plurality of separation slots 2232 defined in the base block 2231 for the placement of the rear connection endpieces 212 of the conductive terminals 21 respectively, a spacer plate 2233 forwardly extended from a front side of the base block 2231 and positioned between the upper block body 221 and the lower block body 222, and two through holes 2234 bilaterally cut through opposing top and bottom surfaces of the spacer plate 2233 for the passing of the mounting rods 2221. The terminal block 22 further comprises a hook block 23 located at a top side of the terminal block 22.

Each electrical wire 3 comprises a conducting core 31, and an insulative sheath 32 made of an insulative material (such as rubber, silicone rubber or plastics) and wrapped about the conducting core 31.

The shielding housing 4 is made of metal in one piece, or assembled with multiple metal pieces, comprising a positioning space 40 cut through opposed front and rear sides thereof and a clamp 41 located at the rear side.

In the present preferred embodiment, the upper block body 221 and lower block body 222 of the terminal block 22 of the terminal set 2 are respectively molded on the upper and lower rows of conductive terminals 21 using insert molding technologies. Alternatively, the upper block body 221 and the lower block body 222 can be separately made and then respectively assembled with the upper and lower rows of conductive terminals 21.

Further, the terminal set 2 has totally 19 pieces of conductive terminals 21 arranged in two vertically spaced rows in a staggered manner. The upper row includes 10 pieces of conductive terminals 21 defined from the left to the right as the $1^{st}$ pin of TMDS Data 2+, the $3^{rd}$ pin of TMDS Data2−, the $5^{th}$ pin of TMDS Data1 Shield, the $7^{th}$ pin of TMDS Data0+, the $9^{th}$ pin of TMDS Data0−, the $11^{th}$ pin of TMDS Clock Shield, the $13^{th}$ pin of CEC, the $15^{th}$ pin of SCL, the $17^{th}$ pin of DDC/CEC Ground and the $19^{th}$ pin of Hot Plug Detect. The lower row includes 9 pieces of conductive terminals 21 defined from the left to the right as the $2^{nd}$ pin of TMDS Data2 Shield, the $4^{th}$ pin of TMDS Data1+, the $6^{th}$ pin of TMDS Data 1−, the $8^{th}$ pin of TMDS Data0 Shield, the $10^{th}$ pin of TMDS Clock+, the $12^{th}$ pin of TMDS Clock−, the $14^{th}$ pin of Reserved(N.C. on device), the $16^{th}$ pin of SDA and the $18^{th}$ pin of +5V Power.

Further, the width of the front contact endpiece 211 from the bent 2112 to the contracting portion 2113 is larger than the width from the contracting portion 2113 to the front contact point 2111. The width X of the front contact endpiece 211 from the bent 2112 to the contracting portion 2113 is within 0.35 mm~0.4 mm. The width Y of the front contact endpiece 211 from the contracting portion 2113 to the front contact point 2111 is within 0.32 mm~0.35 mm. In addition, the front contact point 2111 has a bending angle θ between 48 and 55 degrees, and this angle range can be used to improve the stability of high frequency noise attenuation.

In installation, insert the terminal set 2 into the docking space 10 of the insulative housing 1 to let the front contact endpieces 211 of the upper and lower rows of conductive terminals 21 be positioned in the respective terminal grooves 11 and also to engage the hook block 23 of the terminal block 22 into the hook hole 13 of the insulative housing 1. At this time, the rear connection endpieces 212 of the conductive terminals 21 are disposed outside the rear side of the insulative housing 1. Thereafter, insert the electrical wires 3 into the respective separation slots 2232 of the separator 223 to let the conducting cores 31 and the insulative sheaths 32 of the electrical wires 3 be respectively attached to the conducting core riveting parts 2121 and the insulative sheath riveting parts 2123 of the rear connection endpieces 212 of the conductive terminals 21, and then rivet the riveting strips 2122 and the fastening strips 2124 to the respective conducting cores 31 and the respective insulative sheaths 32. Thus, the electrical wires 3 are accurately and electrically connected with the respective conductive terminals 21, avoiding loosening and detachment.

After the rear connection endpieces 212 of the conductive terminals 21 and the electrical wires 3 are rivetted together, insert the assembly of the insulative housing 1, the terminal set 2 and the electrical wires 3 from the rear side of the shielding housing 4 into the positioning space 40 and then use the clamp 41 to secure the electrical wires 3 in place, forming an electrical connector that conforms to the HDMI 2.1 specification, enabling the assembly of the insulative housing 1, the terminal set 2 and the electrical wires 3 to be shielded by the shielding housing 4 and preventing the multiple electrical wires 3 from scattering and falling off.

When connecting the electrical connector of the present invention to a mating external electrical connector (not shown), the tongue plate of the mating external electrical connector will be inserted into the docking space 10 of the insulative housing 1, and the front contact points 2111 of the conductive terminals 21 of the terminal set 2 will electrically contact the respective electrical contacts at the tongue plate for the transmission of audio and video signals. The width of the front contact endpiece 211 of each conductive terminal 21 is gradually reduced from the terminal block 22 toward the front contact point 2111, so that the attenuation of the transmission noise is more obvious, improved and stable. Because the width of the front contact endpiece 211 is reduced, the spacing between the front contact endpieces 211 of each two adjacent conductive terminals 21 is increased so that adjacent conductive terminals 21 will not interfere with each other. This makes it possible to avoid noise and crosstalk when transmitting signals, and thus the electrical connector of the present invention is more in line with HDMI2.1 specification while ensuring that the quality of high-frequency signal transmission is more stable and reliable.

The present invention has the following advantages:

1. The width of the front contact endpiece 211 of each conductive terminal 21 reduces gradually from the terminal block 22 toward the front contact point 2111 so that the attenuation of the transmission noise is more obvious, improved and stable. Because the width of the front contact endpiece 211 is reduced, the spacing between the front contact endpieces 211 of each two adjacent conductive terminals 21 is increased so that each two adjacent conductive terminals 21 will not interfere with each other, avoiding noise and crosstalk during signal transmission and ensuring high-frequency signal transmission stability and reliability.

2. The rear connection endpieces 212 of the conductive terminals 21 are respectively and firmly secured to the conducting cores 31 and the insulative sheaths 32 of the electrical wires 3 by the respective conducting core riveting parts 2121 and the insulative sheath riveting parts 2123. Because the insulating sheaths 32 of the electrical wires 3 have better elastic deformation characteristics, when the insulating sheath riveting parts 2123 are riveted to the respective insulating sheaths 32, the joint tightness can be improved, thereby ensuring stable electrical connection between the conductive terminals 21 and the electrical wires 3. Moreover, when the electrical wires 3 are shaken, the electrical wires 3 can be easily prevented from being easily separated from the conductive terminals 21, thereby achieving the effect of improving the service life.

3. The separation slots 2232 of the separator 223 of the terminal block 22 are provided for the placement of the rear connection endpieces 212 of the conductive terminals 21, and the conducting cores 31 of the electrical wires 3 are electrically connected with the rear connection endpieces 212 within the respective separation slots 2232. Thus, the multiple separation slots 2232 can be used to separate the rear connection endpieces 212 of the conductive terminals 21, achieving the effect of masking signals and avoiding signal interference between the rear connection endpieces 212 of each two adjacent conductive terminals 21.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electrical connector, comprising an insulative housing, a terminal set mounted in said insulative housing, a plurality of electrical wires connected to said terminal set and a shielding housing surrounding said insulative housing, wherein:

said insulative housing comprises a docking space with an opening in each of opposed front and rear sides thereof;

said terminal set comprises a terminal block mounted in said insulative housing and a plurality of conductive terminals mounted in said terminal block, each said conductive terminal comprising a front contact endpiece extended out of a front side of said terminal block and inserted into said docking space and a rear connection endpiece extended out of an opposite rear side of said terminal block, said front contact endpiece comprising a curved front contact point, said front contact endpiece having a width gradually reduced from said terminal block toward said front contact point;

said electrical wires each comprise a conducting core electrically disposed in contact with said rear connection endpiece of one respective said conductive terminal and an insulative sheath wrapped about said conducting core;

said shielding housing defines therein a positioning space that accommodates said insulative housing;

wherein said conductive terminals of said terminal set are arranged into an upper row and a lower row; said terminal block comprises an upper block body, a lower block body and a separator set between said upper block body and said lower block body, said upper block body holding said upper row of said conductive terminals, said lower block body holding said lower row of said conductive terminals, said separator comprising a base block disposed at a rear side relative to said upper block body and said lower block body, said base block comprising a plurality of separation slots for accommodating said rear connection endpieces.

2. The electrical connector as claimed in claim 1, wherein said insulative housing further comprises a plurality of terminal grooves disposed in said docking space at opposed top and bottom sides for inserting said front contact endpieces of said conductive terminals into said terminal grooves.

3. The electrical connector as claimed in claim 1, wherein said insulative housing further comprises two contracted surfaces respectively extended from two opposite side walls toward a bottom wall thereof.

4. The electrical connector as claimed in claim 1, wherein said insulative housing further comprises a hook hole cut through a top wall thereof; said terminal block of said terminal set comprises a hook block located at a top side thereof and hooked in said hook hole of said insulative housing.

5. The electrical connector as claimed in claim 1, wherein said front contact endpiece of each said conductive terminal further comprises a bent disposed between said terminal block and said front contact point, and a contracting portion connected between said bent and said front contact point and gradually reduced in width from said bent toward said front contact point.

6. The electrical connector as claimed in claim 5, wherein the width of said front contact endpiece from said bent to said contracting portion is larger than the width from said contracting portion to said front contact point.

7. The electrical connector as claimed in claim 5, wherein the width of said front contact endpiece from said bent to said contracting portion is within 0.35 mm~0.4 mm; the width of said front contact endpiece from said contracting portion to said front contact point is within 0.32 mm~0.35 mm; said front contact point has a bending angle within 48°~55°.

8. The electrical connector as claimed in claim 1, wherein said rear connection endpiece of each said conductive terminal comprises a conducting core riveting part backwardly extended out of said terminal block and riveted to said conducting core of one respective said electrical wire, and an insulative sheath riveting part backwardly extended from a rear end of said conducting core riveting part and riveted to said insulative sheath of the respective said electrical wire.

9. The electrical connector as claimed in claim 8, wherein said rear connection endpiece of each said conductive terminal further comprises a plurality of riveting strips vertically upwardly extended from two opposite lateral sides of said conducting core riveting part and riveted to a surface of said conducting core of the respective said electrical wire, and two fastening strips vertically upwardly extended from two opposite lateral sides of said insulative sheath riveting part and riveted to a surface of said insulative sheath of the respective said electrical wire.

10. The electrical connector as claimed in claim 1, wherein said upper block body comprises two mounting grooves respectively located on two opposite lateral sides thereof; said lower block body comprises two mounting rods respectively extended from two opposite sidewalls thereof and respectively engaged into said mounting grooves of said upper block body; said base block comprises a spacer plate forwardly extended from a front side thereof and positioned between said upper block body and said lower block body, said spacer plate having two through holes for the passing of said mounting rods of said lower block body.

11. The electrical connector as claimed in claim 1, wherein said shielding housing further comprises a clamp located at a rear side thereof and clamped on a surface of said electrical wires.

* * * * *